United States Patent [19]

Plaessmann

[11] Patent Number: 5,022,954

[45] Date of Patent: Jun. 11, 1991

[54] APPARATUS FOR APPLYING LABELS TO CONTAINERS

[75] Inventor: Frederick A. Plaessmann, Edison, N.J.

[73] Assignee: Seal Spout Corporation, Liberty Corner, N.J.

[21] Appl. No.: 416,857

[22] Filed: Oct. 4, 1989

[51] Int. Cl.[5] ..... B65C 9/18; B65C 9/14

[52] U.S. Cl. ..... 156/542; 156/541; 156/567; 156/DIG. 33

[58] Field of Search ..... 156/542, 541, 566, 567, 156/571, 572, DIG. 33

[56] References Cited

U.S. PATENT DOCUMENTS

| | | | |
|---|---|---|---|
| 3,129,130 | 4/1964 | Lerner et al. | 156/572 X |
| 3,381,645 | 5/1968 | Klausmann et al. | 113/1 |
| 3,385,248 | 5/1968 | Klausmann et al. | 113/1 |
| 3,523,512 | 8/1970 | Plaessman | 113/1 |
| 3,690,223 | 9/1972 | Klaussman et al. . | |
| 3,738,888 | 6/1973 | Williams | 156/542 X |
| 3,888,724 | 6/1975 | Spannknebel et al. | 156/542 X |
| 4,025,382 | 5/1977 | Del Rosso | 156/542 X |
| 4,072,117 | 2/1978 | Plaessman . | |
| 4,191,607 | 3/1980 | Cope | 156/541 X |
| 4,367,118 | 1/1983 | Karp | 156/542 X |
| 4,547,252 | 10/1985 | La Mers | 156/542 X |
| 4,561,921 | 12/1985 | Treiber | 156/542 X |
| 4,583,899 | 4/1986 | Plaessman . | |
| 4,725,327 | 2/1988 | Matuda et al. | 156/571 X |
| 4,895,614 | 1/1990 | Trouteaud et al. | 156/542 |

*Primary Examiner*—Caleb Weston
*Assistant Examiner*—Mark A. Osele
*Attorney, Agent, or Firm*—Weingram & Zall

[57] ABSTRACT

This invention relates to an apparatus for sequentially applying a label to a surface of each of a plurality of containers comprising an indexing table having means for removably holding a plurality of containers and sequentially conveying each container to a label applying station; means for feeding a continuous web to the label applying station, said web having a plurality of labels removably disposed thereon, each label having a surface with an adhesive thereon; means for removing a label from the web at the label applying station and depositing the label, adhesive side exposed, to a label receiving station; means for positioning the label receiving station to position the label parallel to the surface of the container to which the label is to be applied; means for positioning the label in contact with the surface of the container enabling the adhesive surface to adhere to the container surface; and means for repositioning the label receiving station to permit the depositing of another label from the web to the label receiving station.

32 Claims, 7 Drawing Sheets

10
12
14
16
18
19
20
22
24
26
28
30
31
32
34
36
38
40
44
54
56
80
82
84
86
90
92
94
96
100
102
104
106
108
110
112

FIG-8
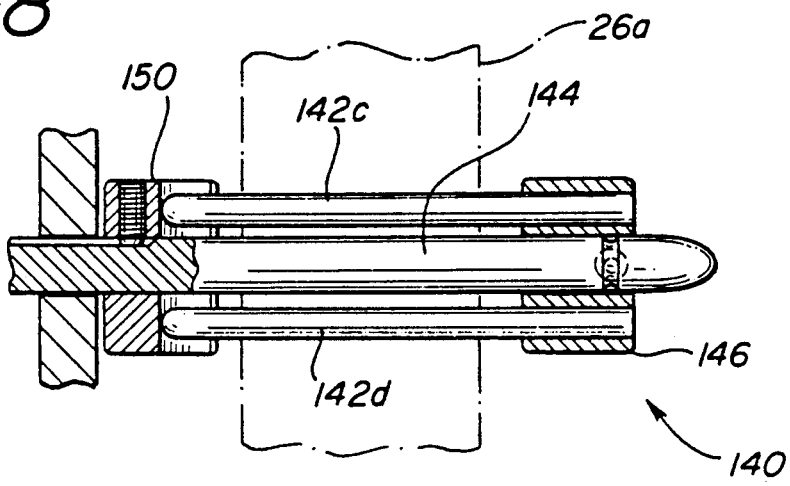
FIG-9
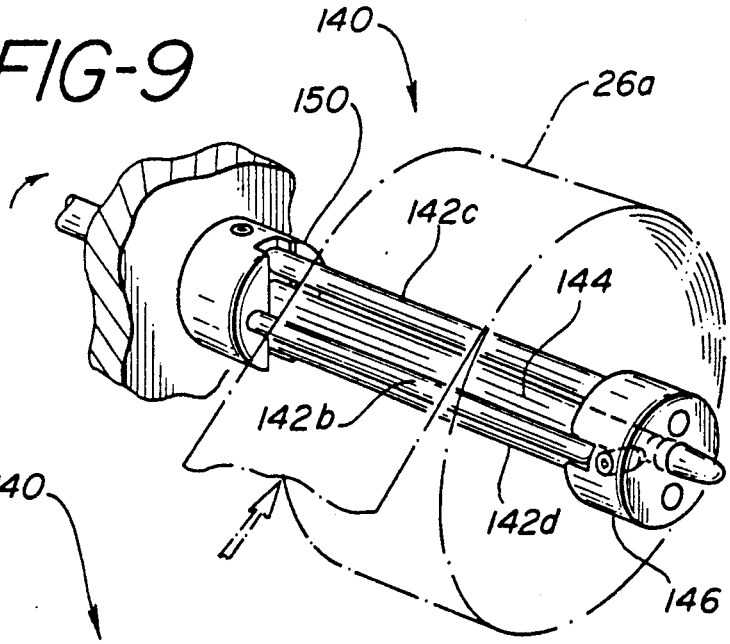
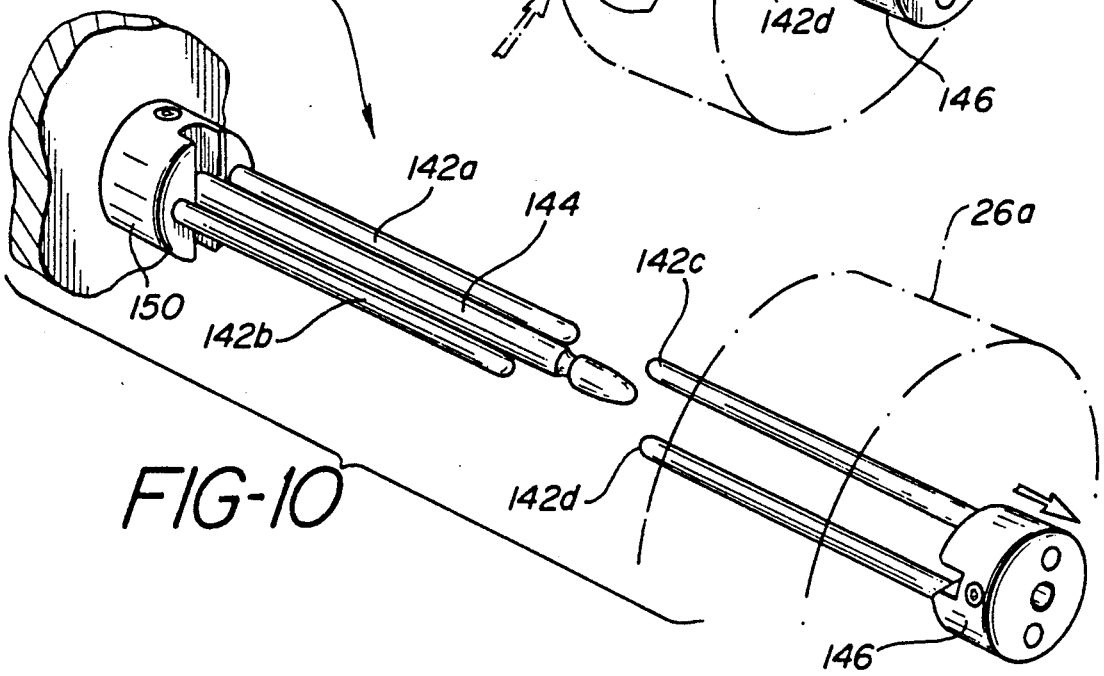
FIG-10

APPARATUS FOR APPLYING LABELS TO CONTAINERS

BACKGROUND OF THE INVENTION

1. Field of the Invention

This invention relates to machines for applying labels to containers and in particular to applying sealing labels over pouring spouts on containers.

2. Description of the Prior Art

The need to install tamper indicating means on packages has been highlighted by the relatively recent intentional contamination of TYLENOL, and other non-prescription drugs and consumable products For dry granular items such as bread crumbs, salt, or other fine powders that are dispensed from boxes or containers, one of the favorite methods of dispensing such granular material is by means of a retractable pouring spout that has been fastened to the box.

Machines for inserting spouts into the tops and sides of containers are known. A spout, generally, is placed in a container after it is filled This makes handling such containers difficult in that any tipping of the container after it is filled and prior to insertion of the spout will result in spilling of material from the container along the production line.

Whether the spout is placed in the container before or after it is filled, insertion of such spouts requires synchronization between filling of the containers, delivery of the container to the insertion station, insertion of spouts therein, speed of the assembly line, etc. Examples of spout inserting machines are described in U.S. Pat. Nos. 4,072,117; 3,690,223; 3,523,512; 3,385,248; 3,381,645; and 4,583,899. The disclosures of all of these patents are incorporated herein by reference.

A problem associated with such spouts is that they are easily tampered with. There is no means by which it can be determined if the spout itself has been opened, other than by providing an overlay on the spout. It is important that such an overlay be positioned exactly on the spout, because if it is not then a contaminant may still be poured into the container through the spout. Thus, the positioning of the overlay label is critical. The label must also not be removable, thus requiring the sealing label to be broken in order to open the spout. A broken sealing label will thus indicate that there has been tampering with the spout.

A known method for sealing spouts is by using a continuous wrapping, e.g. cellophane, to enclose the entire container. For containers which have a spout located on the flat top of the container, a label can be used. In the case of a container with a spout positioned on the side, however, difficulties arise in exactly positioning a sealing label over the spout due to seams, decorations, artwork, etc..

The exact positioning of a label in relation to the spout can be important in maintaining a seal to insure the usefulness of the product therein. For example, in containers which have water sensitive material such as soaps or detergents a label which overlays the spout so as to hermetically seal the spout opening is advantageous in extending the shelf life of the material in the container. The prevention of moisture from entering the container will enable the material to stay in the box without caking or otherwise absorbing the material.

Further, as is often the case in the retail trade, containers having pouring spouts are often stacked one on top of the other. Such stacking tends to crush or distort the containers. By placing a label over the spout it prevents the spout from being forced open by such crushing thereby preventing spilling of the materials from the containers while also making the material in the individual containers less vulnerable to contamination.

SUMMARY OF THE INVENTION

Broadly, this invention provides a machine for automatically and continuously applying labels to containers. A continuous tape or web, having separate labels thereon, is fed to an indexing work table through a label applying apparatus. The label applying apparatus is coordinated with the position of the table, containers on the table, and caps in the containers. The indexing work table moves the containers in a coordinated sequence to a work station wherein the labels are applied at the desired position on the containers over the pouring spouts.

More specifically, this invention is directed to an apparatus for sequentially applying a label to a surface of each of a plurality of containers comprising:

- an indexing table having means for removably holding a plurality of containers and sequentially conveying each container to a label applying station;
- means for feeding a continuous web to the label applying station, said web having a plurality of labels removably disposed thereon, each label having a surface with an adhesive;
- means for removing a label from the web at the label applying station and depositing the label, adhesive side exposed, to a label receiving station;
- means for positioning the label receiving station to position the label parallel to the surface of the container to which the label is to be applied;
- means for positioning the label in contact with the surface of the container enabling the adhesive surface to adhere to the container surface;
- means for repositioning the label receiving station to permit the depositing of another label from the web to the label receiving station.

Accordingly, it is an object of the present invention to provide an apparatus for applying labels to containers which can accurately position the label.

Another object of the present invention is to provide an apparatus for applying labels over pouring spouts in containers which positions the label in proper relationship to the spout.

A further object of the present invention is to provide an apparatus for applying labels to containers which provides a smooth feed of labels and containers to the work station where the labels are applied to the containers.

Yet another object of the present invention is to provide an apparatus for applying labels over pouring spouts of containers, which holds the containers in the proper position for labeling and transports the container to a subsequent operation.

Still another object of the present invention is to provide an apparatus for applying labels to containers which prevents skewing or misalignment of the labels during the application process.

Yet another object of the present invention is to provide an apparatus for applying labels over pouring spouts of containers which does not require a complex delivery or removal apparatus such as a conveyor belt system.

A further object of the present invention is to provide an apparatus for applying labels over pouring spouts of containers with means to easily adjust the speed of the apparatus to coordinate it with variations in manufacturing processes.

Yet, a further object of the present invention is to provide an apparatus for applying labels over pouring spouts of containers which is relatively simple in construction.

Still another object of the present invention is to provide an apparatus for applying labels over pouring spouts of containers which is relatively durable in operation.

Still a further object of the present invention is to provide an apparatus for applying labels over pouring spouts of containers which is extremely reliable during its operation and in the accuracy of the work that it performs.

Another object of the present invention is to provide an apparatus for applying labels over pouring spouts of containers which allows the labels to be accurately positioned with the proper pressure to adhere the label to the container over the spout without crumpling or crushing the container.

Yet another object of the present invention is to provide an apparatus for applying labels over pouring spouts of containers which is adapted for rapid feeding of labels to containers, e.g. more than 100 containers per minute, from a continuous web of labels.

It is yet another object of the present invention to provide an apparatus for applying labels over pouring spouts of containers which is adapted to assembly line production and can accommodate for containers missing from work stations during the production process.

Yet another object of the present invention is to provide an apparatus for applying labels over pouring spouts of containers which allows the labels to be fed at high speed from a continuous web on which the labels to be applied are mounted, and which accurately and effectively controls the proper tension on the web to allow for proper removal of the labels from the web and to prevent the web from kinking or unwanted advancing during the process by which the web advances as the labels are removed.

Other objects and advantages will become apparent from the following description taken in conjunction with the accompanying drawings.

BRIEF DESCRIPTION OF THE DRAWINGS

FIG. 8 is a cross-sectional view of the take up roll as taken along line 8—8 of FIG. 7.

FIG. 9 is a perspective view of the take up roll of FIG. 8.

FIG. 10 is an exploded perspective view of the take up roll of FIG. 9.

DESCRIPTION OF A PREFERRED EMBODIMENT

Figure 1:
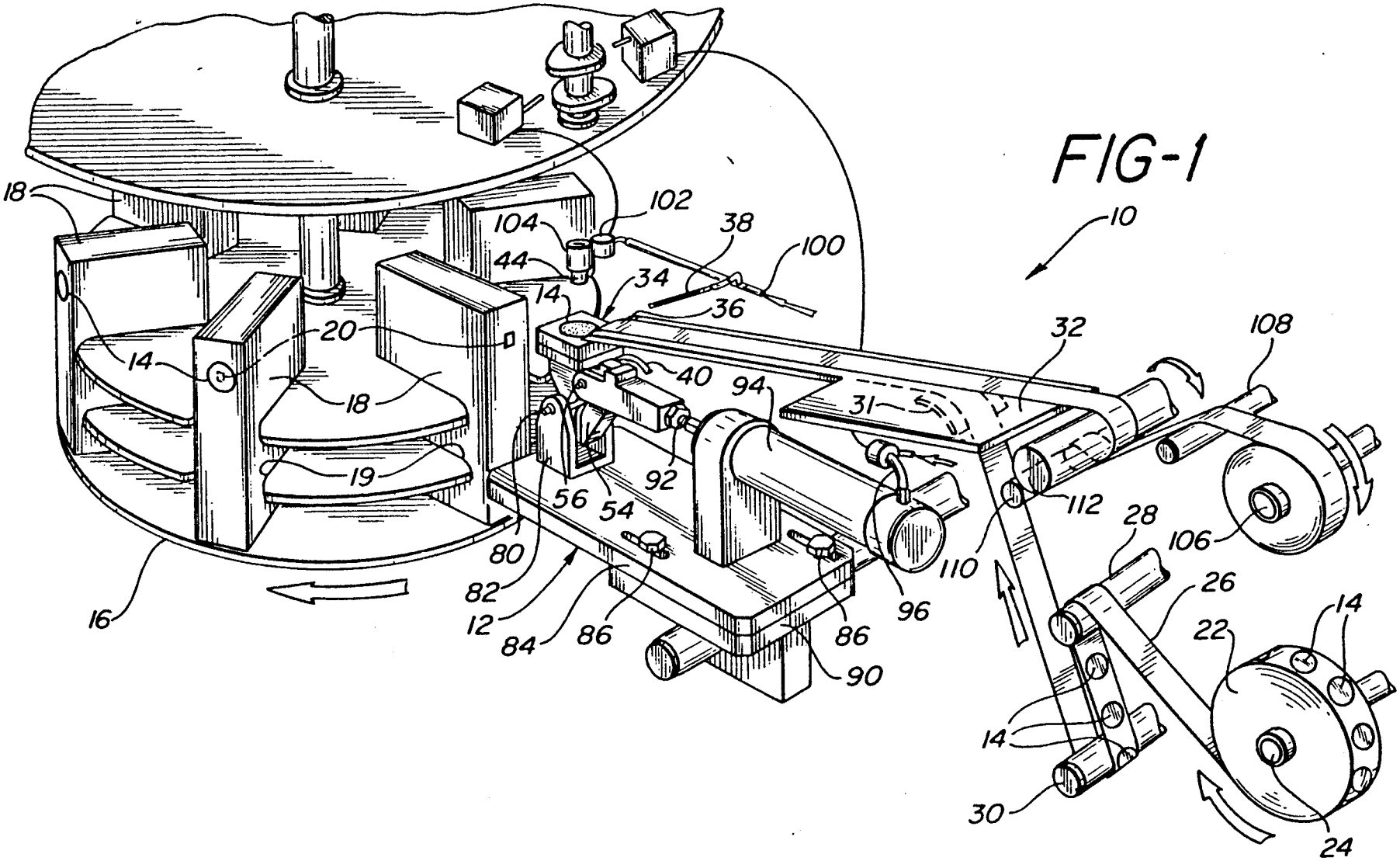
FIG. 1 is a perspective view of one embodiment of the apparatus of this invention showing the label feed mechanism and container indexing table.

Referring to the figures, Figure shows the label applying machine, generally 10, having a support, 12. The label applying machine 10 is associated with and continuously feeds labels 14 toward an indexing table 16 which moves containers 18 to a label applying station where the labels 14 are placed on the containers 18. The indexing table 16 has stations 19 therein for maintaining the containers 18 in a stable position therein. Preferably, the labels 14 are placed on containers lB which have pouring spouts 20 therein. It should be understood, however, that the label applying machine 10 of this invention may be used to sequentially apply labels to any type container or surface. Preferably, the label 14 is applied to a substantially vertical surface, however different arrangements of the apparatus may be utilized to apply the label to any inclination of surface. The label applying machine 10 and indexing table 16 are powered and synchronized by a drive mechanism well known in the art. Preferably, a pneumatic system is used in conjunction with the label applying machine 10 for accomplishing various functions described herein. Of course, other systems such as hydraulic or direct gearing systems can be used to provide the power and drive coordination necessary for the present system.

Referring to FIG. 1, the label applying machine 10 is designed to apply a roll 22 of labels 14 which are evenly spaced thereon. Roll 22 is placed upon a shaft 24, for feeding the labels 14 to the label applying machine 10. The labels 14 are removably adhered by an adhesive to a continuous tape or web 26 from which they can be easily peeled. The adhesive is also used for adhering the label I4 to the container 18. Tape 26 is fed over tension rods 28 and 30. Rods 28, 30 maintain a relatively continuous tension on web 26 to facilitate the feeding of labels 14. The web 26 is then passed over a guide section 31 and along guide plate 32 for directing the web 26 toward the label receiving station 34.

In another embodiment of the invention the tension rods 28 and 30 are replaced by the tensioning system shown in FIG. 7, which will be described further below.

Figure 3A:
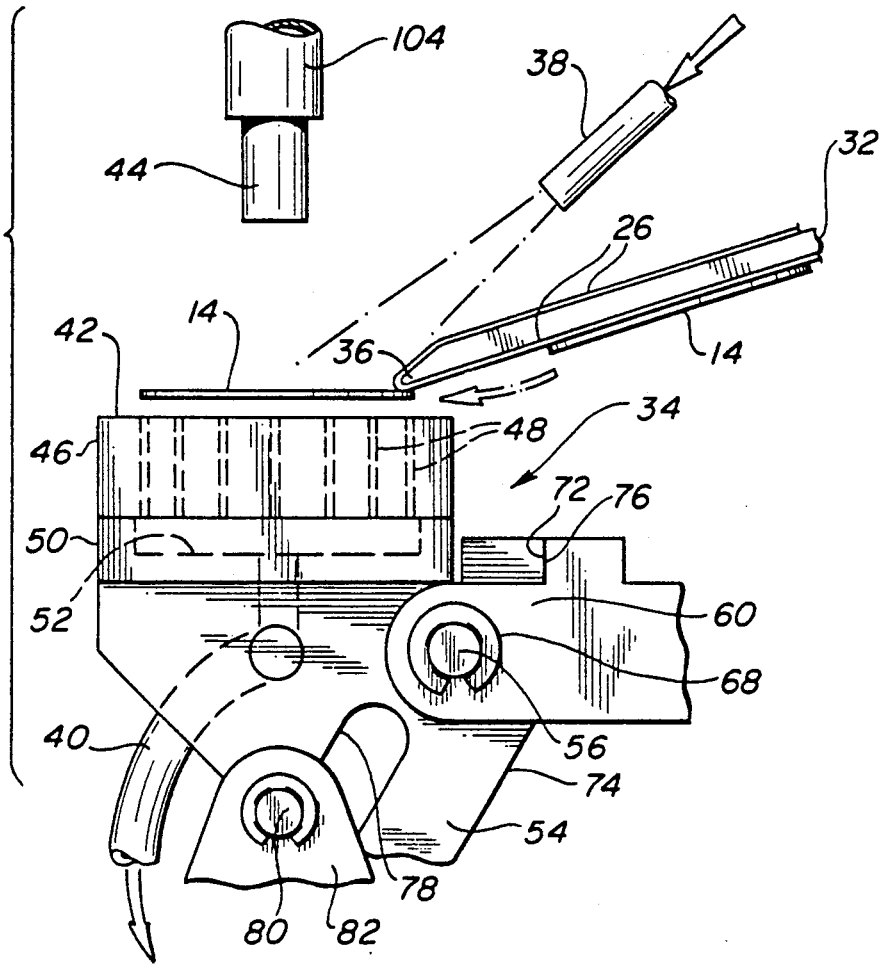
FIG. 3A is a side view of the label receiving station as the label is being deposited on the receiving pad from the continuous tape or web.

Referring to FIG. 3A, guide plate 32 guides the web 26, having the label 14 thereon under knife or peeling edge 36. The web 26 is then directed around and over knife edge 36. Label 14 is removably adhered to web 26 in such a manner that passing web 26 around the knife edge 36 causes label 14 to peel or separate from web 26 and project over the top surface 42 of label receiving station 34. Air jet 38 continuously blows a stream of air in the direction of knife edge 36, preferably tangential to edge 36, assisting label 14 to project across label receiving station 34 and be deposited thereon.

Label receiving station 34 includes a means for applying a continuous suction to label 14 by evacuating air through tube 40. This vacuum assists in positioning and maintaining label 14 on top surface 42 of label receiving station 34 after air jet 44 emits a spurt of air which drives label 14 off the edge of the web at the point where the end of the label 14 is on the knife edge 36, and then down onto the top surface 42 of the label receiving station 34.

Figure 2:
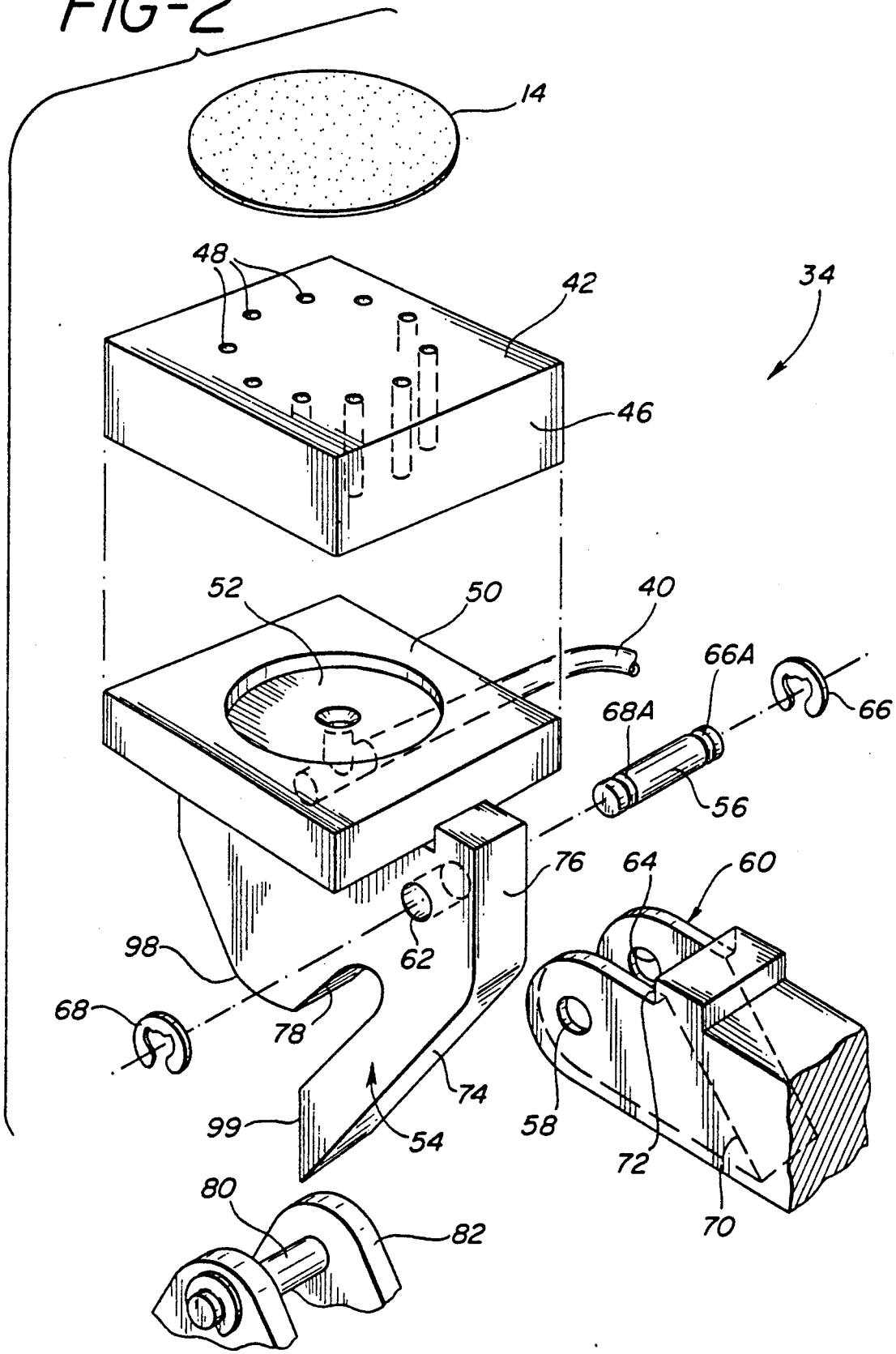
FIG. 2 is an exploded perspective view of the label receiving station.

Referring more particularly to FIG. 2, the label receiving station 34 comprises a label support plate 46 which has a plurality of holes 48 therethrough in a pattern around the circumference of label 14. In the embodiment depicted in FIG. 2, the pattern is circular. Below label support plate 46 is a support plate 50. A plenum chamber 52 is provided therein which is in pneumatic connection with holes 48 when plate 46 is placed thereon. Tube 40 is connected to chamber 52 for drawing a vacuum. When a vacuum is drawn through tube 40, a vacuum is produced in chamber 52, said vacuum being evenly distributed around the periphery of label 14 via holes 48 which maintains label 14 to top surface 42 of label support plate 46.

It should be noted that the label support plate 46 must be specially designed so that it will easily conform to the surface of the container 18 to which the label 14 is applied. This enables equal pressure to be placed on all areas of the label 14 so that the label will then adhere uniformly over its entire surface to the container 18 in which it is applied and not just at isolated or random spots of the label 14. However, the surface must be strong enough so that it can also exert the necessary pressure while conforming to the surface of the container 18.

Figure 5:
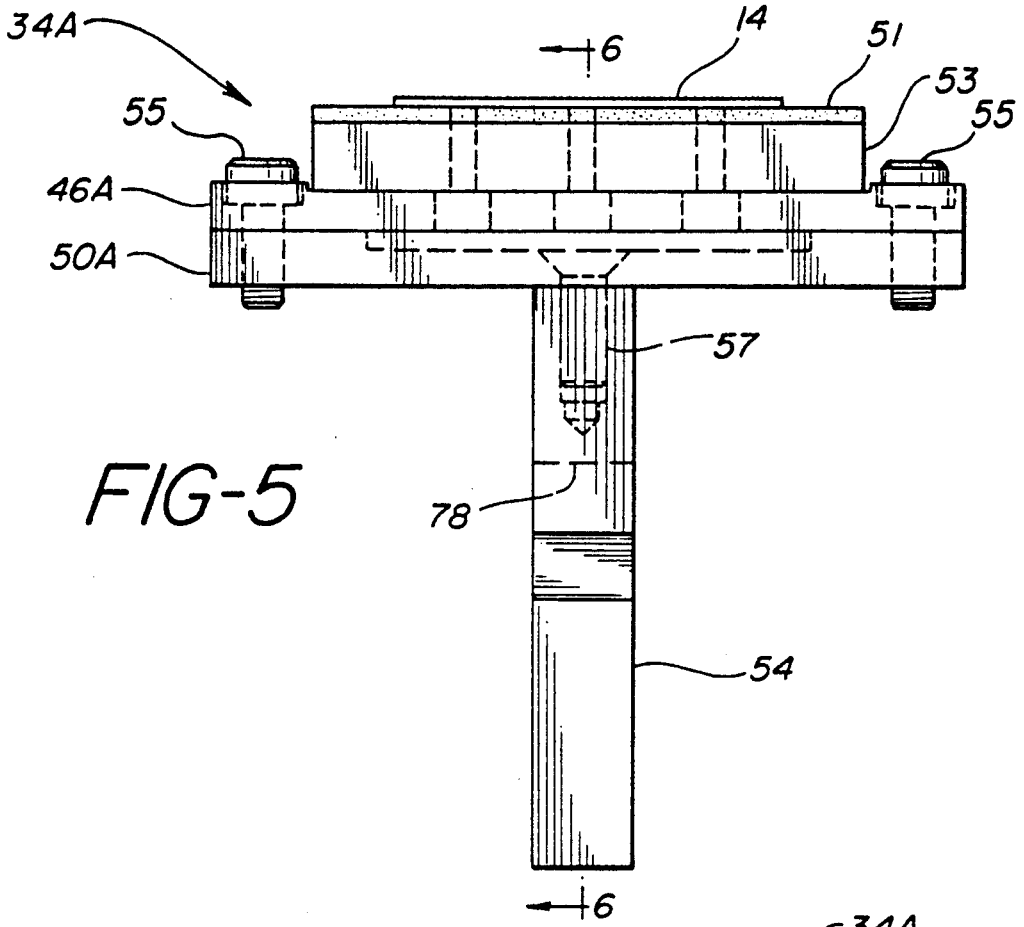
FIG. 5 is a front elevational view of another embodiment of the label receiving station.
Figure 6:
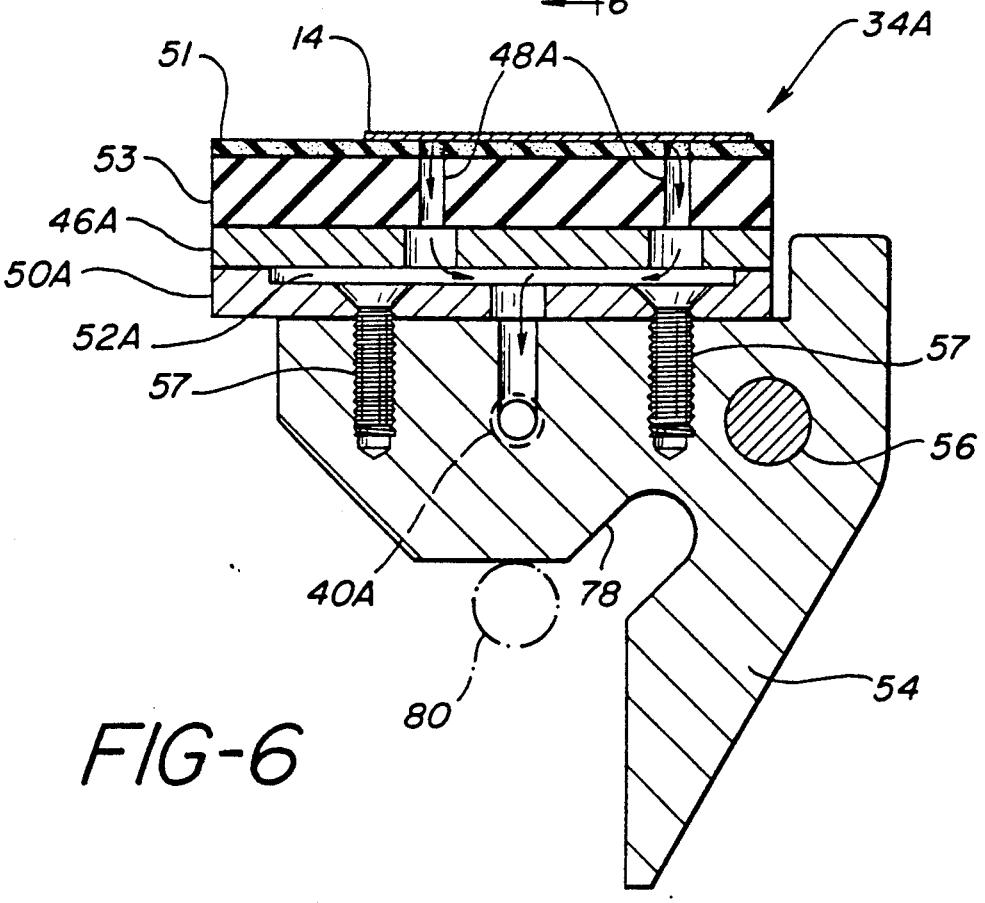
FIG. 6 is a cross-sectional view taken along line 6—6 of FIG. 5.

Another embodiment of a label receiving station is depicted in FIGS. 5 and 6. In this embodiment the label receiving station 34A comprises a label support plate 46A having on the top surface thereof a foam pad 53 having a protective skin thereon 51 to protect the pad 53. Foam pad 53 permits the label 14 to be applied to a surface on a container which is, for example, curved, as in a cylindrical container, the pad 53 conforming to the surface of the container. This enables pressure to be applied equally to all areas of the label. Pad 53 is adhered to support plate 46A which is removably mounted to support plate 50A by a plurality of bolts 55. When pad 53 and skin 51 wear out they thus may be easily replaced. Support plate 50A is mounted on cam 54 by a plurality of screws 57. A plenum chamber 52A is provided in plate 50A which is in pneumatic connection with holes 48A which pass through plate 46A, pad 53 and skin 51. Tube 40A is connected to chamber 52A for drawing a vacuum which maintains label 14 on skin 51.

Referring to FIG. 2, support plate 50 is mounted on cam 54. Cam 54 is supported by and pivots about pin 56. Pin 56 passes through a hole 58 in the left arm of fork 60, hole 62 in cam 54 and through hole 64 in the right arm of fork 60. The ends of pin 56 are secured by snap rings 66 and 68 mating in the end channels 66(*a*) and 68(*a*) of pin 56.

Fork 60 has therein surfaces 70 and 72 which mate with cam surface 74 and 76, respectively. When fork surface 70 and cam surface 74 are juxtaposed against each other, the top surface 42 of label support plate 46 is in a substantially vertical position. When fork surface 72 and cam surface 76 are juxtaposed against each other the top surface, surface 42 of label support plate 46 is in a substantially horizontal position. It should be understood, however that this invention is not limited to a top surface 42 of label support plate 46 having only these two positions. Broadly, when surface 42 of the label support plate 46 is in a substantially horizontal position, it is in a position to receive label 14, and when surface 42 of plate 46 is in a substantially vertical position, the plate 46 is in a position to apply the label 14 to container 18.

A slot 78 is provided in cam 54. Slot 78 mates with and rotates about pin 80. Pin 80 is held in a fixed position in fork 82 by snap rings or the like, fork 82 being affixed to adjustable plate 84. (See FIG. 1.)

Referring to FIG. 1, plate 84 is in a substantially fixed position during operation of the apparatus. Adjusting bolts 86, 88 may be loosened to permit plate 84 to slide on fixed plate 90 to properly adjust the distance between label support plate 46 and container 18.

Figure 4A:
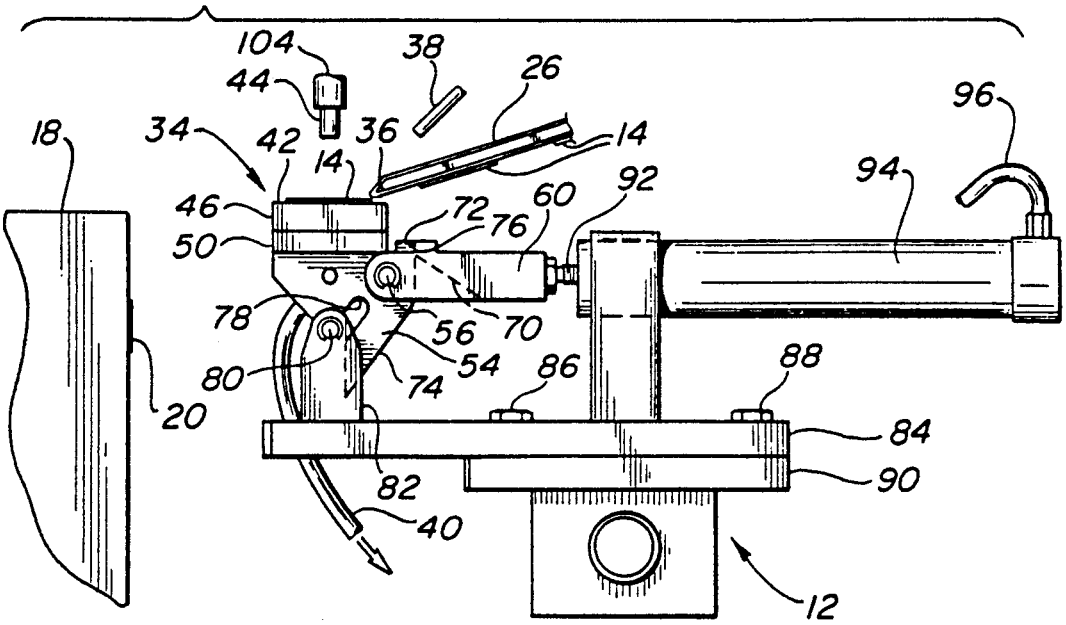
FIG. 4A is a side view of the label feeding mechanism, having the label on the receiving pad just after being deposited thereon.
Figure 4B:
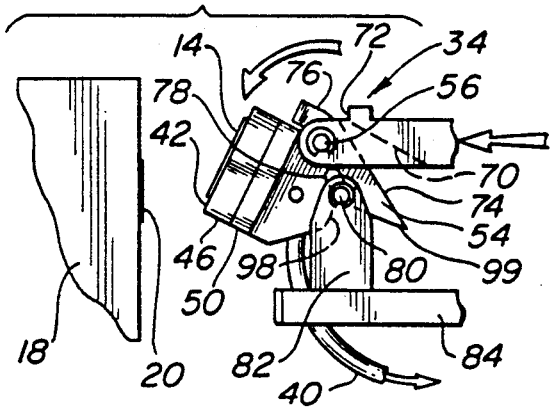
FIG. 4B is a partial side view of the label receiving station, having the label on the receiving pad, as the receiving station is being moved toward the container.
Figure 4C:
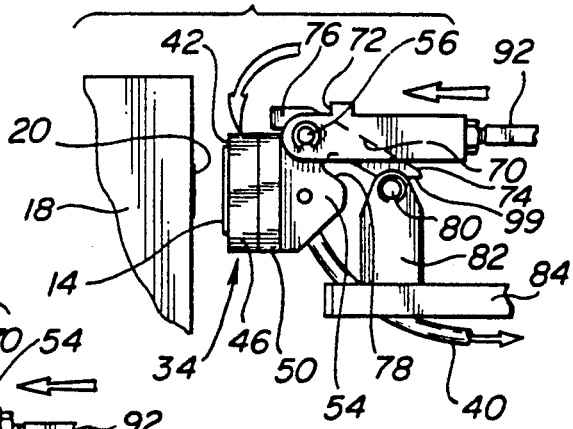
FIG. 4C is a partial side view of the label receiving station, having the label on the receiving pad, as the receiving station is being moved toward the container, just prior to contact of the label with the container.
Figure 4D:
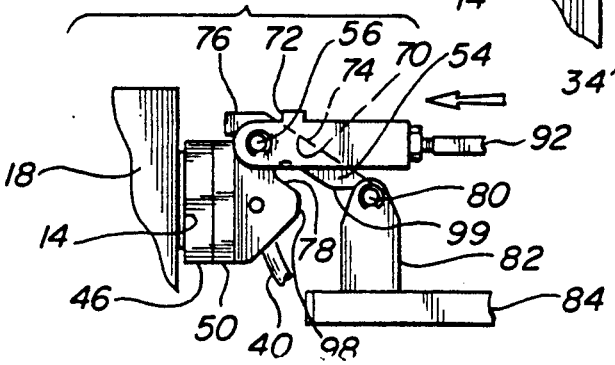
FIG. 4D is a partial side view of the label receiving station showing the label in contact with and being adhesively applied to the container.

Referring to FIGS. 1 and 4A, fork 60 is attached to cylinder rod 92. Rod 92 is intermittently activated through pneumatic cylinder 94. Air is applied to cylinder 94 through hose 96. Referring to FIG. 2 and sequentially to FIGS. 4A through 4D, after the label 14 is deposited on label support plate 46, rod 92 is pushed toward container 18 by pneumatic cylinder 94, pushing fork 60 and cam 54 toward container 18. As cylinder rod 92 extends toward container 18, surface 98 on cam 54 rides on top of pin 80 until slot 78 engages and pivots about pin 80 causing the label support plate 50 to change its angle from a label receiving position, e.g. substantially horizontal, toward a label applying position, e.g. substantially vertical. As cylinder rod 92 extends toward container 18, surface 99 on cam 54 rides on pin 80, until label 14 comes in contact with container 18 and adheres thereto. Upon retraction of cylinder rod 92 through the spring return of cylinder 94, surface 99 rides on pin 80 until slot 78 engages and pivots about pin 80 causing the label support plate 50 to pivot away from the label applying position, e.g. substantially vertical, toward the label receiving position, e.g. substantially horizontal. Another label is then applied to the label receiving station.

Figure 3B:
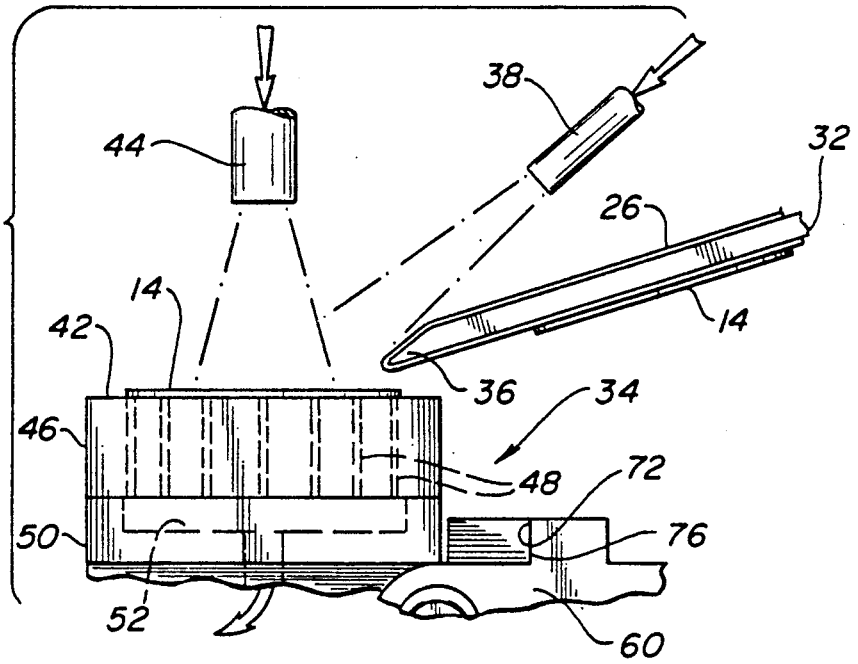
FIG. 3B is a side view of the label receiving station just after the label has been deposited on the receiving pad.

Referring to FIGS. 1, 3A and 3B, air jets 38 and 44 have air supplied thereto through tube 100. Tube 100 supplies air continuously to tube 38 to assist in depositing the label 14 removed from web 26 onto the label receiving station 34. Tube 100 also supplies air to air jet 44. Air through air jet 44 is intermittently controlled by solenoid air valve 102 which is activated by and associated with a detection means for detecting when the label 14 is present on the label receiving station. This activation of valve 102 can be by cam and an electric eye mechanism. For example, as shown in FIG. 1, a cam mechanism and electric eye system, indicated at 104, can be used to control the electric solenoid valve to cause the puff of air to occur in relation to the position of the cams shown. Alternatively, an electric eye system can be used to indicate the presence of the label at the peeling edge of the guide plate causing actuation of the solenoid air valve to thereby release a puff of air to help position the label at the peeling edge of the guide plate onto the receiving surface of the label.

Referring to FIG. 1, after the labels 14 are removed from web 26, web 26 is rolled onto take up roll 106. Guide rods 108, 110 and feed roller 112 are used to feed the labels by taking up web 26. The feed roller 112 is controlled by a sensor (not shown) which senses the proper positioning of the label 14 on the label support plate 46.

In operation, labels 14 are continuously fed to the label support plate 46 and pneumatically held thereon. The support plate 46 is shifted from a substantially horizontal to a substantially vertical position, by cylinder rod 92 toward container 18 and the associated camming action by cam 54. The label 14 is then applied to the container 18 which is held in a firm position in a pocket or slot 19 by indexing table 16. Label support plate 50 is then moved to a substantially horizontal position where another label 14 is received thereon and the next container 18 is moved to the label applying station.

Figure 7:
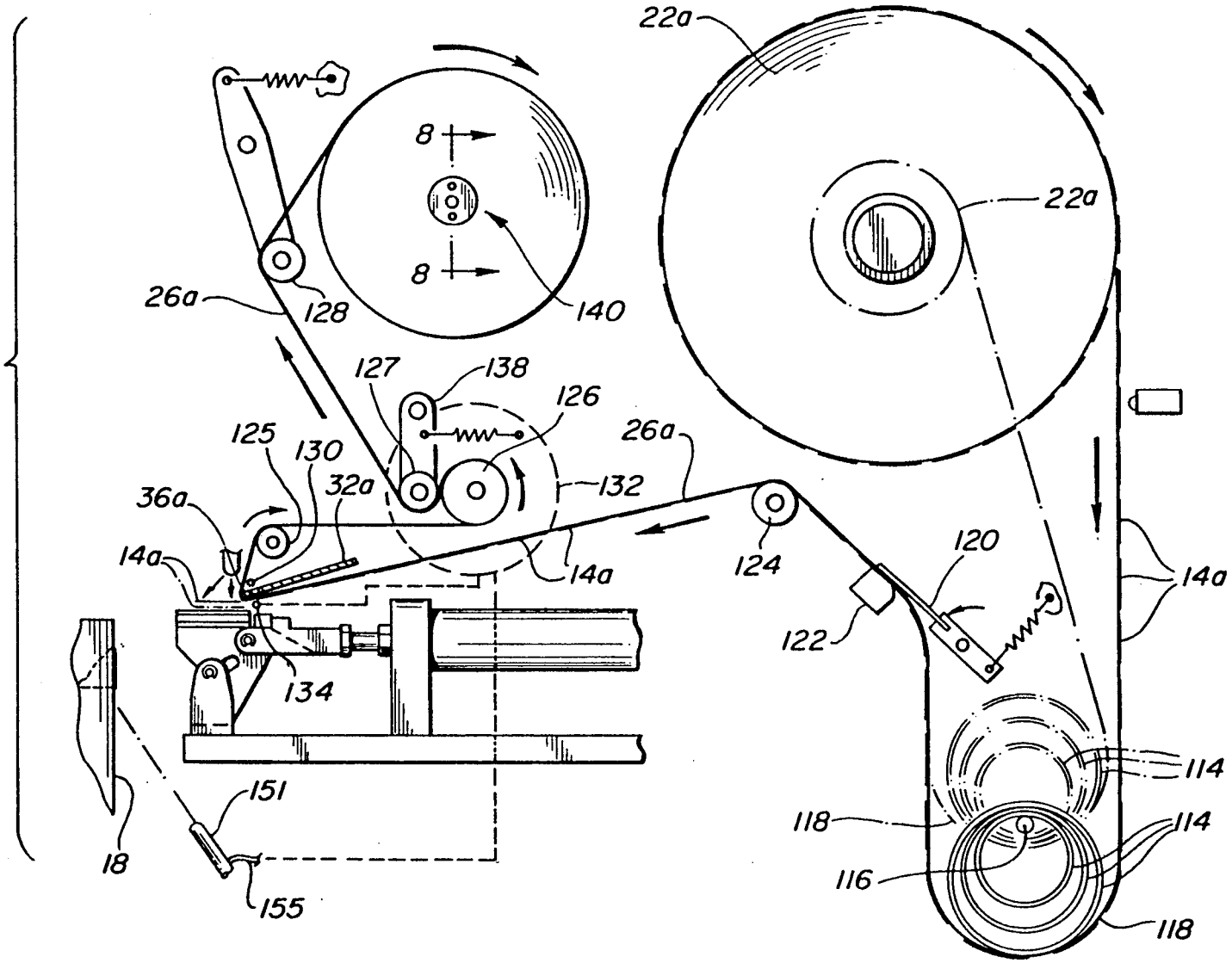
FIG. 7 is a schematic side elevational view of another embodiment of the tensioning system used for feeding the continuous web of labels.
Figure 7A:
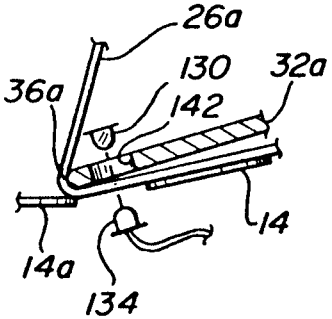
FIG. 7A is a partial schematic side elevation depicting a means for detecting the appropriate placement of a label from the web in order to control the feed of the web.

Another preferred embodiment of the label feed mechanism is shown in FIGS. 7 and 7A. This mechanism provides for a means of ensuring appropriate transport of the labels **14*a* and label web or tape 26*a* to the label receiving station from a large supply source, e.g. roll 22*a* of labels. In this embodiment labels 14*a* are adhered to the web 26*a* and supplied in a large roll or drum generally indicated as 22*a*. Guide rollers 124 and 125 act with friction drive roller 126 so as to frictionally pull the web 26*a* feeding the labels 14*a* to the label receiving station. Proper tensioning of the web 26*a* with labels 14*a* thereon is very important to ensure proper peeling of the label 14*a* from the web 26*a* by the knife edge 36*a*** and to prevent kinking of the web which can effect the accuracy of application of the labels to the containers.

Web **26*a* extends downward from drum 22*a* past a photoelectric eye 111 which monitors the end of the web 26*a* and will stop the apparatus when the eye 111 does not detect any web. The label bearing web 26*a* forms a loop 118 around a plurality of eccentric cylinders 114 mounted on a rod 116. The cylinders 114 rest within the web loop 118 providing tension to the web 26*a*, riding up and down on rod 116 as conditions vary. The web 26*a* then passes up through a spring mounted friction foot 120, which presses against a block 122 ensuring a certain amount of drag between the friction foot 120 and the knife or peeling edge 36*a* of the guide plate 32*a*. Web 26*a* then passes over a guide roller 124 and then to the end of the guide plate 32*a* where knife or peeling edge 36*a* is located. The web 26*a* is then directed backwards over the peeling edge 36*a* to peel label 14*a* from web 26*a*. Web 26*a* having the labels peeled therefrom is then directed over guide roller 125, and then to drive roller 126, passing tension roller 127 and then around spring tensioned roller 128 to the take up roller 140**.

Referring to FIGS. 7 and 7*a*, a light source 130 and receiver 134 sense when there is a space on web **26*a* and transmit a signal (as shown by the dashed line) to the stepping motor 132 which controls drive roller 126. The space sensed transmits a signal which will stop the stepping motor 132 so that the web 26 will not advance, and the web will remain stopped until the box 18, which is sensed by sensor 151 by, for example, an electric eye, detects that the box 18 has moved. When the box 18 moves, the sensor transmits a signal via line 155 (shown in a second dashed line) to the stepping motor 132 to start the motor and advance the web 26. The web 26 will continue to advance until the light extending from the source 130 to the receiver 134 is interrupted by another label. Therefore, the web 26 will advance a sufficient distance to draw the next label into position before it is peeled off and placed on the label receiving portion 46**.

Web **26*a* is directed backward at an angle greater than 90 degrees from the direction of travel of web 26*a*, over peeling edge 36*a* of the guide plate 32*a*, (FIG. 7A shows an approximate 120 degree angle), and then over a guide roller 125, and drive roller 126. Web 26*a* then winds between drive roller 126 and friction roller 127, the tension being controlled by means of a spring mechanism 138. Web 26*a* then goes to a second tension roller or idler 128 which ensures that there are no loops or kinks in the path of the web 26*a* until it goes to the takeup roller 140**.

The idler arm or tension roller assembly 128 serves an important function. Takeup roller 140 is driven by a relatively stable motor which does not move in complete synchronization and speed with stepping motor 132 which drives drive roller 126. Therefore, idler arm assembly 128 enables the web **26*a* that has been stripped of labels to maintain a continuous take up speed while the web 26*a* is being moved in short bursts of activity by the stepping motor 132 so that it can be continuously wound onto takeup roller 140**.

Referring now to FIGS. 8 through 10, takeup roller 140 for the stripped web **26*a* has a spool mechanism which allows for removal of the entire reel of the stripped web without rewinding the roller. This is done by means of a four (4) pin hub arrangement in which a central axial shaft 144 has four satellite pins 142*a*, *b*, *c* and *d* spaced about it. The takeup roller 140 breaks apart about the shaft so that two (2) of the pins 142*c* and 142*d* stay with the disengaged portion 146 and the two (2) remaining pins 142*a* and 142*b* stay with the fixed hub 150 of takeup roller 140. By having the four (4) pin arrangement the tape automatically pinches on itself once it is fed through any of the pins around the axis when the reel 140 is rotated 90** degrees.

The means for tensioning the web **26*a*, i.e. cylinders 114 in loop 118, having labels thereon is important to ensure that short episodic and relatively jerky motions of the stepping motor 132 do not jerk on web 26*a* coming off the magazine roll 22*a*, tending to cause the web to bunch or kink and disrupt operations. It is important to have a relatively smooth flow of web 26*a*. This is accomplished by means of eccentric cylinders 114. The cylinders hang from a central rod or post 116, and as the magazine roll 22*a* unravels, the web goes underneath the largest of the cylinders and then up through the friction shoe 120 over the guide roller 124 to the guide plate 32*a*. At the beginning of the magazine roll 22*a* of web 26*a*, the amount of tension provided to rotate the magazine roll is greater than required as the magazine roll 22*a* later decreases in size as it is consumed. This requires, therefore, an adjustment as the roll 22*a* dispenses the laden web 26*a*. This adjustment is accomplished by means of the eccentric cylinders 114. When only a small amount of tension is necessary to rotate the magazine roll 22*a*, the web drawn from the magazine 22*a* bears the weight of only the lowermost cylinder. As more tension becomes necessary to rotate the magazine roll in a relatively smooth nature, the loop 118 shortens, causing the loop 118 to bear the weight of, for example, two cylinders, thereby increasing the tension. The process is increased until the weight of as many other cylinders as necessary are used to maintain the magazine roller 22***a* at the proper angular velocity. The tension provided by the cylinders 114 can be adjusted by adjusting the weight of the individual cylinders, e.g., adjusting the size, and/or density of material.

From the previous description, it can be seen that the invention has several useful features. First, it does not require elaborate mean of synchronizing or indexing the transportation of containers to be processed for applying labels. The mechanism provides for rugged, dependable and durable operation. The speeds can be easily controlled by means of changing the speed of the indexing table and piston mechanism.

It will be understood that the various changes in the details, materials, and arrangement of parts which have been described and illustrated herein ma be made by those skilled in the art.

What is claimed is:

1. An apparatus for sequentially applying a label to a surface of each of a plurality of containers comprising:

an indexing table having means for removably holding a plurality of containers whereby a surface thereof is substantially vertical and sequentially conveying each container to a label applying station;

means for feeding a continuous web to the label applying station, the applying station comprising a label receiving station and an associated cam surface and pivoting pin, the web having a plurality of labels removably disposed thereon, each label having a surface with an adhesive thereon;

means for removing a label from the web at the label applying station and depositing the label, adhesive side exposed, on a substantially horizontal label receiving station;

a piston means acting on the label applying station causing the cam surface to pivot about the pivoting pin to thereby position the substantially horizontal label receiving station to a substantially vertical position whereby the label is parallel to the substantially vertical surface of the container to which the label is to be applied;

piston means extending the applying station to thereby position the label in contact with the surface of the container enabling the adhesive surface to adhere to the container surface; and means for repositioning and retracting the label receiving station to a substantially horizontal position to permit the depositing of another label from the web to the label receiving station.

2. The apparatus of claim wherein the indexing table is circular.

3. The apparatus of claim 1, wherein the means for removing the label includes a peeling edge proximate to the label receiving station wherein the web is directed toward the label receiving station on one side of the edge, directed over the edge, and directed away from the label receiving station on the other side of the edge, whereby the label is removed from the web by the edge and deposited on the label receiving station.

4. The apparatus of claim 3, further comprising an air jet directed toward the removed label to assist in depositing the label on the label receiving station.

5. The apparatus of claim 4, wherein the air jet emits a continuous jet of air.

6. The apparatus of claim 4, further comprising a second air jet directed toward the removed label which assists in maintaining the label on the receiving station after the label is deposited thereon.

7. The apparatus of claim 6, wherein the second air jet emits a jet of air only when the label is deposited on the label receiving station.

8. The apparatus of claim 7, wherein the second air jet is activated by a means for detecting the presence of a label on the label receiving station.

9. The apparatus of claim 3, further comprising a means for producing a vacuum in the label receiving station for maintaining the label thereon.

10. The apparatus of claim 1, further comprising means for applying continuous tension to the web.

11. The apparatus of claim 10, wherein the means for applying tension comprises at least one tension rod disposed along the web length before the web is fed to the label applying station.

12. The apparatus of claim 10, wherein the means for applying tension comprises at least one tension rod disposed along the web length after the web is fed to the label applying station.

13. The apparatus of claim 10, wherein the means for applying tension comprises a varying weight which increases or decreases as tension on the web, respectively, increases or decreases and a loop of the web supporting the weight.

14. The apparatus of claim 13, wherein the loop of the web has a plurality of labels thereon.

15. The apparatus of claim 14, wherein the varying weight comprises a plurality of cylinders disposed within each other supported on an axially disposed rod.

16. The apparatus of claim 1, wherein the label receiving station comprises means for conforming the label to the surface of the container.

17. The apparatus of claim 16, wherein the means for conforming comprises a foam pad supporting the label deposited on the label receiving station.

18. The apparatus of claim 1, further comprising a means for taking up the web after the label is removed therefrom.

19. An apparatus for sequentially applying a label to a surface of each of a plurality of containers comprising:

an indexing table having means for removably holding a plurality of containers whereby a surface thereof is substantially vertical and sequentially conveying each container to a label applying station;

means for feeding a continuous web to the label applying station, the label applying station comprising a label receiving station and an associated cam surface and pivoting pin the web having a plurality of labels removably disposed thereon, each label having a surface with an adhesive thereon;

means for removing a label from the web at the label applying station and depositing the label, adhesive side exposed, on a substantially horizontal label receiving station;

wherein the means for removing the label includes a peeling edge proximate to the label receiving station wherein the web is directed toward the label receiving station on one side of the edge, directed over the edge, and directed away from the label receiving station on the other side of the edge, whereby the label is removed from the web by the edge and deposited on the label receiving station;

piston means acting on the label applying station causing the cam surface to pivot about the pivoting pin to thereby position the substantially horizontal label receiving station to a substantially vertical position whereby the label is parallel to the substantially vertical surface of the container to which the label is to be applied;

piston mans extending the applying station to thereby position the label in contact with the surface of the container enabling the adhesive surface to adhere to the container surface;

means for repositioning and retracting the label receiving station to a substantially horizontal position to permit the depositing of another label from the web to the label receiving station;

wherein the label receiving station comprises means for conforming the label to the surface of the container;

means for applying continuous tension to the web; and means for taking up the web after the label is removed therefrom.

20. The apparatus of claim 19, wherein the indexing table is circular.

21. The apparatus of claim 19, further comprising an air jet directed toward the removed label to assist in depositing the label on the label receiving station.

22. The apparatus of claim 21, wherein the air jet emits a continuous jet of air.

23. The apparatus of claim 21, further comprising a second air jet directed toward the removed label which assists in maintaining the label on the receiving station after the label is deposited thereon.

24. The apparatus of claim 23, wherein the second air jet emits a jet of air only when the label is deposited on the receiving station.

25. The apparatus of claim 24, wherein the second air jet is activated by a means for detecting the presence of a label on the label receiving station.

26. The apparatus of claim 19, further comprising a means for producing a vacuum in the label receiving station for maintaining the label thereon.

27. The apparatus of claim 19, wherein the means for conforming comprises a foam pad supporting the label deposited on the label receiving station.

28. The apparatus of claim 19, wherein the means for applying tension comprises at least one tension rod disposed along the web length before the web is fed to the label applying station.

29. The apparatus of claim 19 wherein the means for applying tension comprises at least one tension rod disposed along the web length after the web is fed to the label applying station.

30. The apparatus of claim 19, wherein the means for applying tension comprises a varying weight which increases or decreases as tension on the web, respectively, increases or decreases, and a loop of the web supporting the web.

31. The apparatus of claim 30, wherein the loop of the web has a plurality of labels thereon.

32. The apparatus of claim 30, wherein the varying weight comprises a plurality of cylinders disposed within each other supported on an axially disposed rod.

* * * * *